US006670924B1

(12) United States Patent
Shoji et al.

(10) Patent No.: US 6,670,924 B1
(45) Date of Patent: Dec. 30, 2003

(54) ANTENNA ELEMENT AND PORTABLE INFORMATION TERMINAL

(75) Inventors: Hideaki Shoji, Hyogo (JP); Yasuhito Imanishi, Hyogo (JP); Toru Fukasawa, Hyogo (JP); Hiroyuki Ohmine, Hyogo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/009,495

(22) PCT Filed: Apr. 13, 2000

(86) PCT No.: PCT/JP00/02428

§ 371 (c)(1),
(2), (4) Date: Dec. 13, 2001

(87) PCT Pub. No.: WO01/80367

PCT Pub. Date: Oct. 25, 2001

(51) Int. Cl.[7] ..... H01Q 1/24
(52) U.S. Cl. ..... 343/702; 343/893; 343/895
(58) Field of Search ..... 343/700 MS, 702, 343/725, 729, 829, 846, 872, 893, 895, 900

(56) References Cited

U.S. PATENT DOCUMENTS 6,137,446 A * 10/2000 Ha et al. ..... 343/702
6,198,442 B1 * 3/2001 Rutkowski et al. ..... 343/702
6,211,830 B1 * 4/2001 Monma et al. ..... 343/702
6,326,924 B1 * 12/2001 Muramoto et al. ..... 343/702
6,342,859 B1 * 1/2002 Kurz et al. ..... 343/702
6,388,626 B1 * 5/2002 Gamalielsson et al. ..... 343/702

FOREIGN PATENT DOCUMENTS

| | | |
|---|---|---|
| JP | 62-34407 | 2/1987 |
| JP | 07-094923 | 4/1995 |
| JP | 7-94923 | 7/1995 |
| JP | 08-78929 | 3/1996 |
| JP | 9-181512 | 7/1997 |
| JP | 09-181512 | 7/1997 |
| JP | 10-79612 | 3/1998 |
| JP | 10-079612 | 3/1998 |
| JP | 10-135733 | 5/1998 |
| JP | 10-303622 | 11/1998 |
| JP | 11-177331 | 7/1999 |
| JP | 11-251825 | 9/1999 |
| JP | 11-261318 | 9/1999 |
| JP | 11-308038 | 11/1999 |
| JP | 2000-151244 | 5/2000 |

* cited by examiner

*Primary Examiner*—Don Wong
*Assistant Examiner*—Shih-Chao Chen
(74) *Attorney, Agent, or Firm*—Oblon, Spivak, McClelland, Maier & Neustadt, P.C.

(57) ABSTRACT

An antenna element includes a plate antenna which is substantially equivalent to a series resonant circuit, and a monopole antenna which is connected to the plate antenna and is substantially equivalent to a parallel resonant circuit.

9 Claims, 22 Drawing Sheets

ANTENNA ELEMENT AND PORTABLE INFORMATION TERMINAL

This application is the national phase under 35 U.S.C. §371 of PCT International Application No. PCT/JP00/02428 which has an Internal filing date of Apr. 13, 2000, which designated the United States of America and was not published in English.

FIELD OF THE INVENTION

This present invention relates to an antenna element and a portable information terminal, particularly to an antenna element used in a portable telephone and a portable telephone using the antenna.

BACKGROUND ART

As an antenna element for transmission and reception in portable telephones, there has been hitherto known, for example, a monopole antenna or a helical antenna set up to extend in the longitudinal direction of their case.

The impedance of such an antenna element is different from the impedance of a radio section inside the portable telephones. It is therefore necessary to match these impedances with each other. For this purpose, in conventional portable telephones, a matching circuit is arranged between their radio section and their antenna element.

In recent years, a portable information terminal which can achieve two functions as a portable telephone and a personal handy-phone system (PHS) has been developed. A portable telephone and a PHS are different from each other in the radio frequencies (band) used for transmission and reception of information. In the case that information communication is carried out in any one band, an antenna is generally designed in the manner that the voltage standing wave ratio (VSWR) of the antenna is set to 2 or less in the band. It is therefore necessary that in the portable information terminal which can achieve two functions as a portable telephone and a PHS, the VSWR of its antenna is set to 2 or less in plural bands or a broad band. However, in conventional antennas having such a matching circuit as described above, the band in which the VSWR of the antennas is 2 or less is narrow. Thus, it is difficult that the conventional antennas are used as portable information terminals having the above-mentioned plural functions.

The conventional matching circuit is composed of lumped-parameter elements such as a coil and a condenser. Therefore, when electrical signals are transmitted from a radio section to an antenna element through the matching circuit, loss is generated in the coil and condenser in the matching circuit to cause a problem that transmission efficiency of the electrical signals is lowered.

Thus, the present invention has been made to overcome the above-mentioned problems.

An object of the present invention is to provide an antenna element and a portable information terminal in which loss of electrical signals is small to give high efficiency.

Another object of the present invention is to provide an antenna element and a portable information terminal having a broad usable band.

DISCLOSURE OF THE INVENTION

The antenna element according to the present invention includes a first antenna part which is substantially equivalent to a series resonant circuit, and a second antenna part which is brought with contact with and connected to the first antenna part and is substantially equivalent to a parallel resonant circuit.

In the antenna element having this structure, the first antenna part is substantially equivalent to the series resonant circuit and the second antenna part is substantially equivalent to the parallel resonant circuit. Therefore, the first antenna part and the second antenna part have impedance characteristics reverse to each other. By jointing the two antenna parts having the reverse impedance characteristics in above-mentioned way, their reactances are mutually cancelled out. In this way, the impedance of the antenna element and that of a radio section can be matched with each other so that a usable band can be made broad without using any matching circuit.

Since the impedances can be matched with each other by jointing the two antenna parts, it is unnecessary to set a matching circuit as seen in the prior art. As a result, loss of electrical signals in the matching circuit can be prevented. Thus, the antenna element of the present invention has a high efficiency.

Preferably, the first antenna part and the second antenna part are fitted in series to a feeding point.

Preferably, the first antenna part and the second antenna part are fitted in parallel to a feeding point.

Preferably, the first antenna part includes a plate antenna, and the second antenna part includes a linear antenna.

Preferably, the linear antenna includes at least one selected from the group consisting of a monopole antenna and a helical antenna.

Preferably, the antenna element further includes a substrate whose surface has an electrical conductivity; the first antenna part is set up, through a dielectric, over the surface of the substrate; and the second antenna part is set up to extend from the substrate.

In this case, the first antenna part is set up, through the dielectric, over the surface of the substrate; therefore, the wavelength of a radio wave advancing in the first antenna part can be made short. As a result, the length of the first antenna part can be made short so that the size of the antenna element can be made small. The second antenna part is set up to extend from the substrate; therefore, the second antenna part can transmit and receive the radio wave certainly without being affected by the substrate.

Preferably, the antenna element further includes a substrate whose surface has an electrical conductivity; and the first antenna part and the second antenna part are set up, through a dielectric, over the surface of the substrate. In this case, the first antenna part and the second antenna part are set up, through the dielectric, over the surface of the substrate; therefore, the wavelength of a radio wave advancing in the first and second antenna parts can be made short. As a result, the size of the first and second antenna parts can be made small so that the size of the antenna element can be made small.

Preferably, the second antenna part includes at least one selected from the group consisting of a monopole antenna, a helical antenna, a meander line antenna, and a zigzag antenna.

The portable information terminal according to the present invention includes an antenna element including a first antenna part which is substantially equivalent to a series resonant circuit, and a second antenna part which is brought with contact with and connected to the first antenna part and is substantially equivalent to a parallel resonant circuit.

In the portable information terminal having this structure, the first antenna part is substantially equivalent to the series resonant circuit and the second antenna part is substantially equivalent to the parallel resonant circuit. Therefore, the first antenna part and the second antenna part have impedance characteristics reverse to each other. By jointing the two antenna parts having the reverse impedance characteristics, their reactances are mutually cancelled out. Thus, the impedance of the antenna element and that of a radio section can be matched with each other. As a result, the portable information terminal has a broad usable band.

Since the impedances can be matched without using a matching circuit as seen in the prior art, loss of electrical signals in the matching circuit is not generated. Thus, the portable information terminal of the present invention has a high efficiency.

BEST MODES FOR CARRYING OUT THE INVENTION

Figure 1:
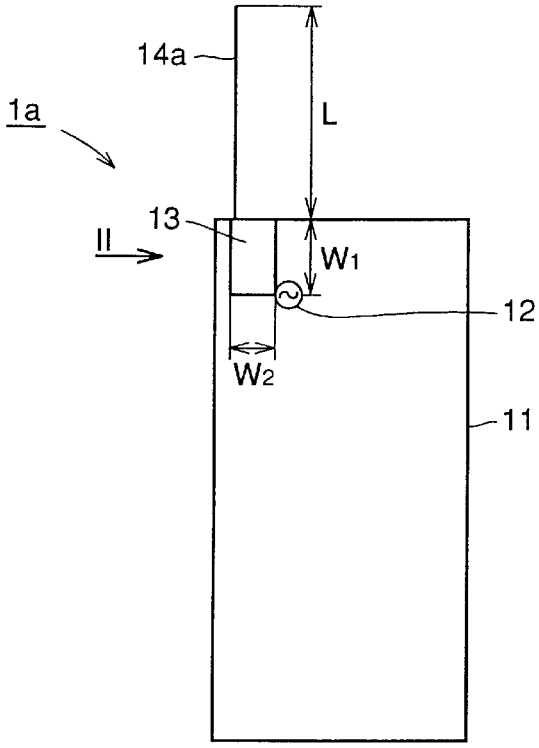
FIG. 1 is a plan view of an antenna element according to a first embodiment of the present invention.

Referring to the drawings, embodiments of the present invention will be described hereinafter.

First Embodiment

FIG. 1 is a plan view of an antenna element according to the first embodiment of the present invention. Referring to FIG. 1, an antenna element 1*a* has a plate antenna 13 as a first antenna part which is substantially equivalent to a series resonant circuit, a monopole antenna 14*a* as a second antenna part which is connected to plate antenna 13 and is substantially equivalent to a parallel resonant circuit, and a metal substrate 11 as a base plate.

Plate antenna 13 is composed of a microstrip line. The electric length of plate antenna 13 is about $\lambda/4$. A feeding point 12 is connected to one end of plate antenna 13. Feeding point 12 is a point which is connected to a given radio section. The radio section and plate antenna 13 are connected to each other through feeding point 12. Monopole antenna 14*a* is connected to the other end of plate antenna 13.

Monopole antenna 14*a* is formed to extend in the longitudinal direction of metal substrate 11. Monopole antenna 14*a* and plate antenna 13 are fitted in series to feeding point 12. The electric length of monopole antenna 14*a* is about $3\lambda/8$. This monopole antenna 14*a* has the so-called anti-resonance characteristic. Monopole antenna 14*a* and plate antenna 13 fulfill functions for transmission and reception of radio waves.

Metal substrate 11 is formed by depositing a metal layer (for example, a copper layer) on a given insulating substrate. The metal layer deposited on the insulating substrate has an electric conductivity which is substantially equal to that of copper. Metal substrate 11 is substantially rectangular. Long sides thereof are along the direction in which monopole antenna 14*a* extends.

Figure 2:
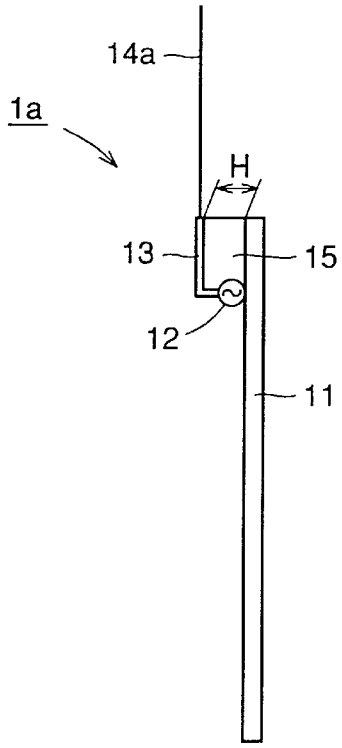
FIG. 2 is a side view of the antenna element, as is viewed from the direction shown by an arrow 11 in FIG. 1.

FIG. 2 is a side view of the antenna element, as is viewed from the direction shown by an arrow II in FIG. 1. Referring to FIG. 2, antenna element 1*a* has metal substrate 11, plate antenna 13 and monopole antenna 14*a*. Metal substrate 11 is in the form of a thin plate and is formed so as to extend in one direction. The radio section (not illustrated) is fitted up onto metal substrate 11. This radio section is connected to plate antenna 13 through feeding point 12. Plate antenna 13 is in an L-shaped member. One end of plate antenna 13 is connected to feeding point 12. The other end thereof is connected to monopole antenna 14*a*. A dielectric 15 is inserted between plate antenna 13 and metal substrate 11. Dielectric 15 is made of Teflon (relative dielectric constant: 2.1). Plate antenna 13 is made of copper.

Figure 3:
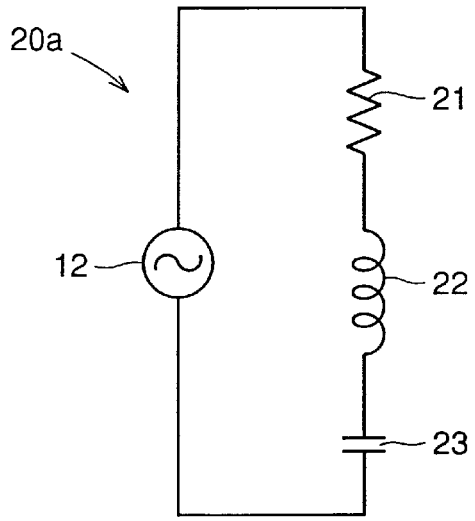
FIG. 3 is an equivalent circuit diagram of a plate antenna.
Figure 4:
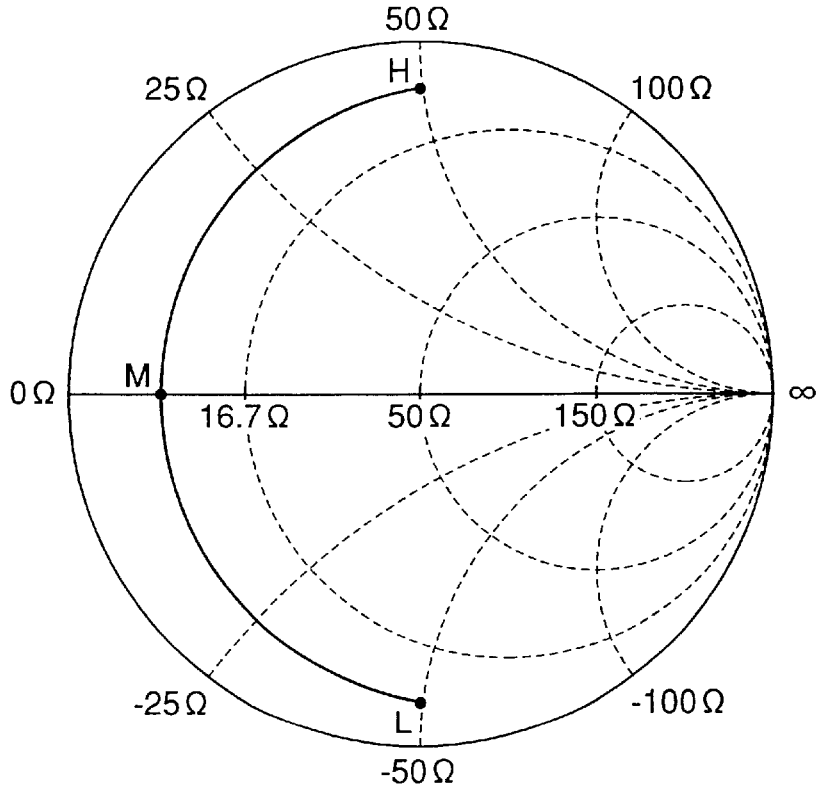
FIG. 4 is a Smith chart for explaining the property of the plate antenna.

FIG. 3 is an equivalent circuit diagram of the plate antenna. FIG. 4 is a Smith chart for explaining the property of the plate antenna. Referring to FIG. 3, plate antenna 13 is substantially equivalent to a series resonant circuit 20*a* wherein a resistance 21, a coil 22 and a condenser 23 are connected in series to feeding point 12.

Referring to FIG. 4, about frequencies higher than frequencies near a resonance point, the imaginary part of the impedance of the plate antenna is positive as shown at a point H since this antenna is substantially equivalent to the series resonant circuit as illustrated in FIG. 3. On the other hand, about frequencies lower than the frequencies near the resonance point, the imaginary part of the impedance is negative as shown at a point L.

Figure 5:
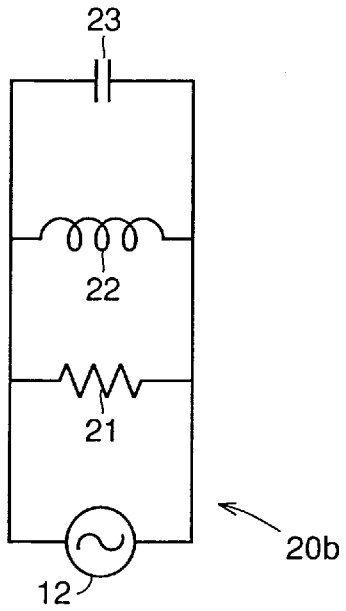
FIG. 5 is an equivalent circuit diagram of a monopole antenna.
Figure 6:
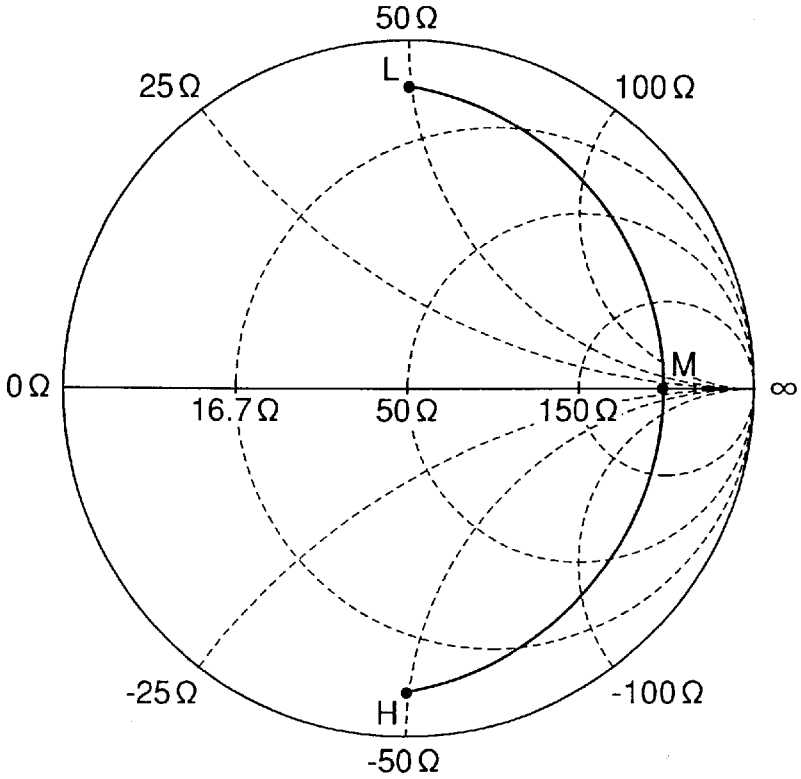
FIG. 6 is a Smith chart for explaining the property of the monopole antenna.

FIG. 5 is an equivalent circuit diagram of the monopole antenna. FIG. 6 is a Smith chart for explaining the property of the monopole antenna. Referring to FIG. 5, the monopole antenna is substantially equivalent to a parallel resonant circuit 20*b* wherein a resistance 21, a coil 22 and a condenser 23 are connected in parallel to feeding point 12. Referring to FIG. 6, about frequencies higher than frequencies near a resonance point, the imaginary part of the impedance of monopole antenna 14*a* is negative. On the other hand, about frequencies lower than the frequencies near the resonance point, the imaginary part of the impedance is positive as shown at a point L.

Figure 7:
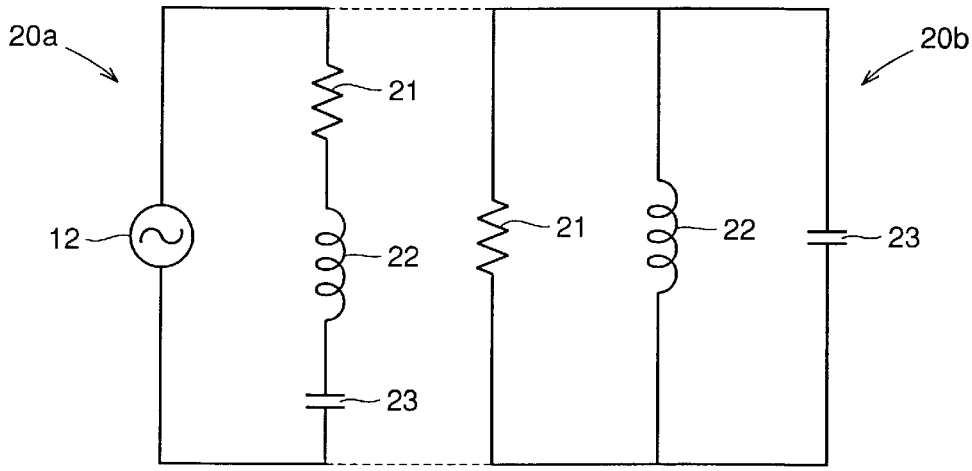
FIG. 7 is an equivalent circuit diagram of the antenna element illustrated in FIGS. 1 and 2.
Figure 8:
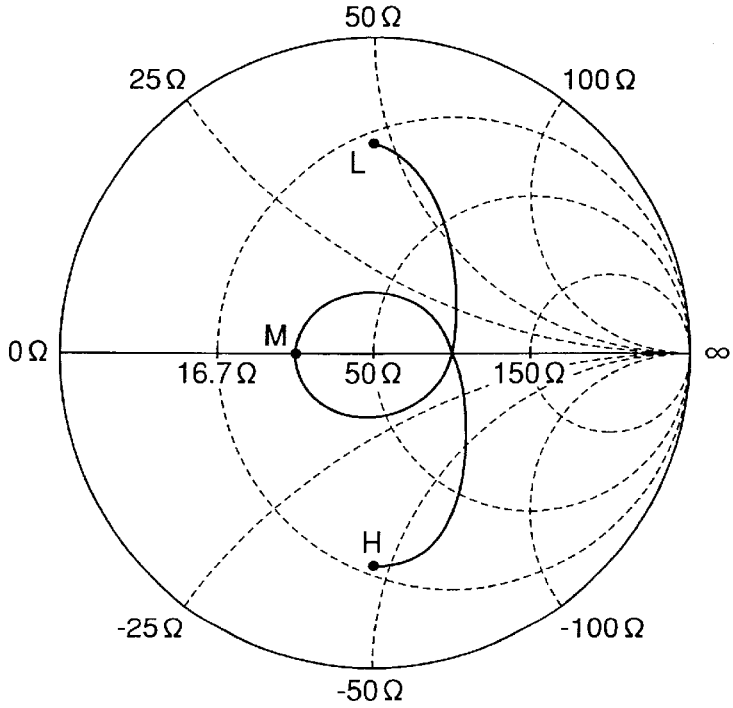
Fig. 8 is a Smith chart for explaining the property of the antenna illustrated in FIGS. 1 and 2.

FIG. 7 is an equivalent circuit diagram of the antenna element illustrated in FIGS. 1 and 2. Referring to FIG. 7, antenna element 1*a* is equivalent to a circuit wherein series resonant circuit 20*a* and parallel resonant circuit 20*b* are jointed to each other. FIG. 8 is a Smith chart for explaining the property of the antenna illustrated in FIGS. 1 and 2. Referring to FIG. 8, the Smith chart of the antenna according to the present invention is a synthesis of the Smith chart of the plate antenna, shown in FIG. 4, and the Smith chart of the monopole antenna, shown in FIG. 6. That is, the imaginary part of the impedance is negative to the radio wave having the highest frequency, shown at a point H. However, the reflection coefficient (the distance from the center of the Smith chart to point H) to the radio wave shown at point H in FIG. 8 is smaller than the reflection coefficient at point H in FIGS. 4 and 6. As the frequency becomes smaller, the track of the impedance is nearer to the central point. Thus, at an intermediate point M of the frequency, the imaginary part of the impedance is zero. When the frequency is made smaller, the track of the impedance is shifted to be away from the central point. Thus, the track reaches a point L having the smallest frequency. The reflection coefficient at point L in FIG. 8 is smaller than that at points L shown in FIGS. 4 and 6.

In FIG. 8, series resonant circuit 20*a* and parallel resonant circuit 20*b* are connected to each other. Therefore, each of the two circuits cancels the property of the opponent circuit. As a result, the reflection coefficient is small over a broad band. In other words, the track of the impedance of the present invention concentrates nearer to the central point, as compared with conventional monopole antennas and plate antennas, so that an antenna having a broad usable band can be produced. Since the impedance approaches 50 Ω, the impedance of the antenna and that of the radio section can be matched with each other without setting up any conventional matching circuit. As a result, a matching element can be omitted so that loss of electric signals based on the matching element can be prevented.

The electric length of monopole antenna 14*a* can be made to an electric length represented by $3\lambda/8+(\lambda/2)\times N$, wherein N is an integer, and having anti-resonance characteristic. The electric length of plate antenna 13 can be made to an electric length represented by $\lambda/4+(\lambda/2)\times N$, wherein N is an integer, and having resonance characteristic. In the above-mentioned example, plate antenna 13 and monopole antenna 14*a* are set up over one surface of metal substrate 11, but plate antennas 13 and monopole antennas 14*a* may be set up over both surfaces of metal substrate 11.

Second Embodiment

Figure 9:
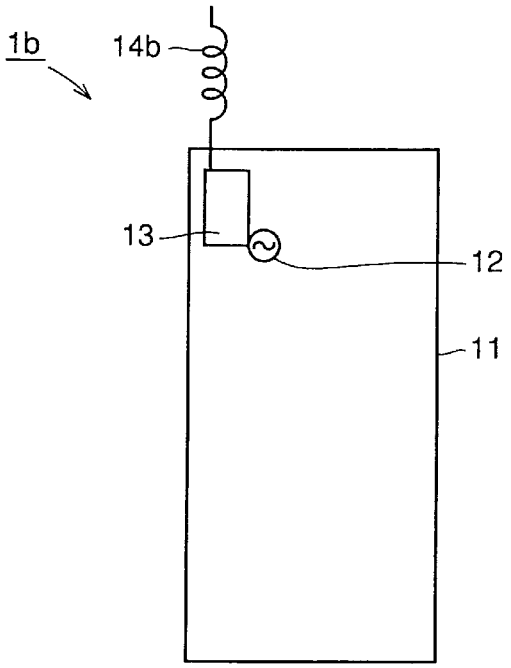
FIG. 9 is a plan view of an antenna element according to a second embodiment of the present invention.

FIG. 9 is a plan view of an antenna element according to the second embodiment of the present invention. Referring to FIG. 9, an antenna element 1*b* according to the second embodiment is different from antenna element 1*a* illustrated in FIGS. 1 and 2 in that antenna element 1*b* has a helical antenna 14*b* as the second antenna part.

Helical antenna 14*b* generally has a narrow usable band. According to the present invention, even if helical antenna 14*b* is used, an antenna element having a broad usable band can be produced.

By using helical antenna 14*b*, the physical length of the antenna element can be made small.

THIRD EMBODIMENT

Figure 10:
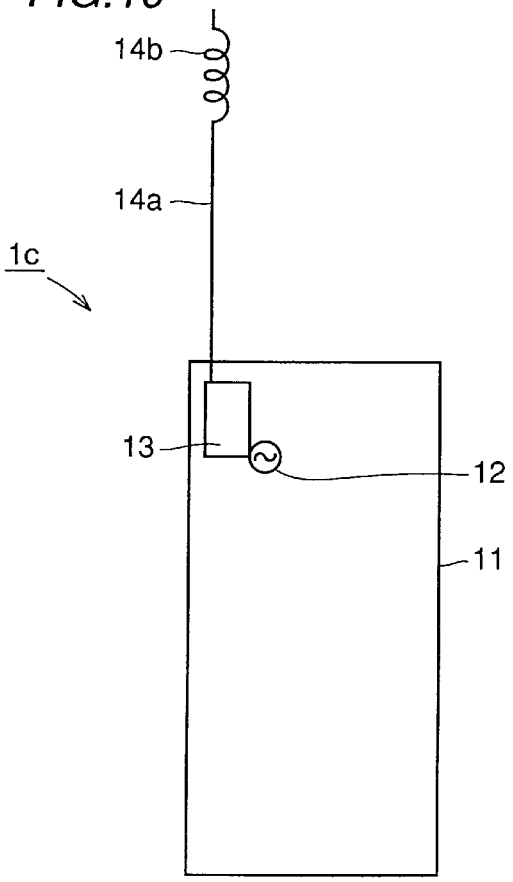
FIG. 10 is a plan view of an antenna element according to a third embodiment of the present invention.

FIG. 10 is a plan view of an antenna element according to the third embodiment of the present invention. Referring to FIG. 10, an antenna element 1*c* according to the third embodiment is different from antenna element 1*a* illustrated in FIGS. 1 and 2, wherein only monopole antenna 14*a* is set up as the first antenna part, in that a monopole antenna 14*a* and a helical antenna 14*b* are set up as the first antenna part.

Antenna element 1*c* having the above-mentioned structure also has the same advantages as the antenna element illustrated in FIG. 1. Furthermore, by combining monopole antenna 14*a* with helical antenna 14*b*, properties dependently on use or purposes can be exhibited.

FOURTH EMBODIMENT

Figure 11:
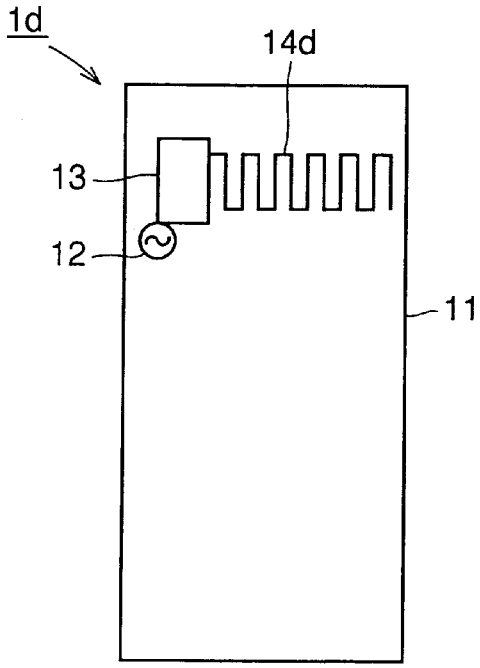
FIG. 11 is a plan view of an antenna element according to a fourth embodiment of the present invention.

FIG. 11 is a plan view of an antenna element according to the fourth embodiment of the present invention. Referring to FIG. 11, an antenna element 1*d* according to the fourth embodiment is different from antenna element 1*a* illustrated in FIGS. 1 and 2, wherein monopole antenna 14*a* is set up to extend from metal substrate 11, in that a meander line antenna 14*d* is used as the first antenna part and this meander line antenna 14*d* is set up on metal substrate 11.

Meander line antenna 14*d* is set up to interpose air between antenna 14*d* and metal substrate 11. One end of antenna 14*d* is connected to a plate antenna 13.

Antenna element 1*d* having the above-mentioned structure also has the same advantages as antenna element 1*a* illustrated in FIGS. 1 and 2. Furthermore, an antenna, such as monopole antenna 14*a* illustrated in FIGS. 1 and 2, does not project from metal substrate 11 since meander line antenna 14*d* is made on metal substrate 11. As a result, the whole of antenna element 1*d* can be made thin and small.

FIFTH EMBODIMENT

Figure 12:
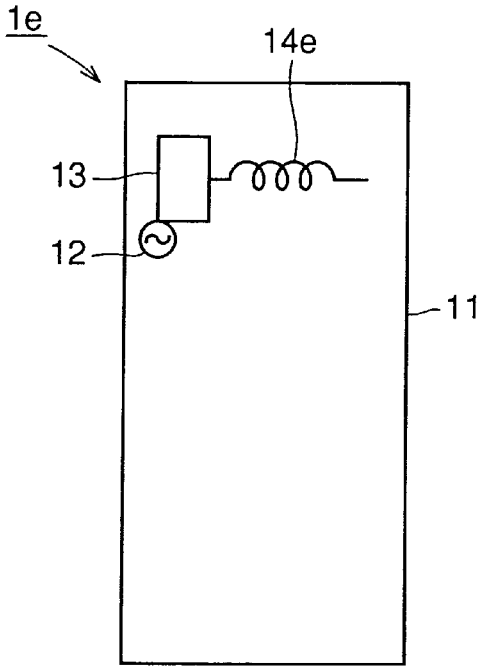
FIG. 12 is a plan view of an antenna element according to a fifth embodiment of the present invention.

FIG. 12 is a plan view of an antenna element according to the fifth embodiment of the present invention. Referring to FIG. 12, an antenna element 1*e* according to the fifth embodiment is different from antenna element 1*d* illustrated in FIG. 11, which has meander line antenna 14*d* as the second antenna part, in that antenna element 1*e* has a helical antenna 14*e* as the second antenna part.

Antenna element 1*e* having the above-mentioned structure also has the same advantages as antenna element 1*d* illustrated in FIG. 11.

SIXTH EMBODIMENT

Figure 13:
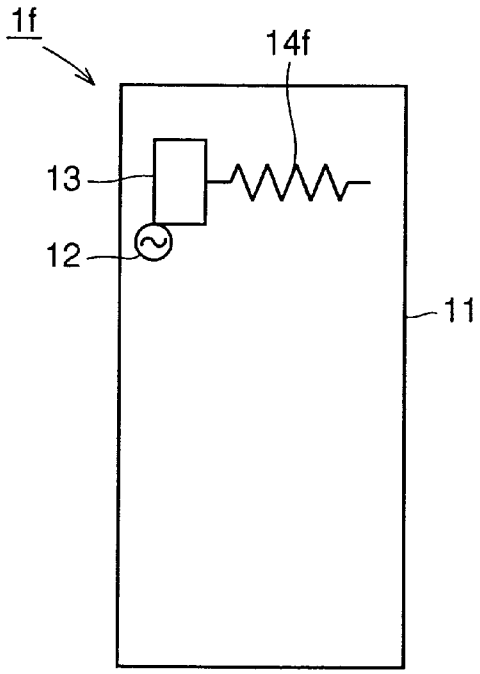
FIG. 13 is a plan view of an antenna element according to a sixth embodiment of the present invention.

FIG. 13 is a plan view of an antenna element according to the sixth embodiment of the present invention. Referring to FIG. 13, an antenna element if according to the sixth embodiment is different from antenna element 1*d* illustrated in FIG. 11, which has meander line antenna 14*d* as the second antenna part, in that antenna element If has a zigzag antenna 14*f* as the second antenna part.

Antenna element if having the above-mentioned structure also has the same advantages as antenna element id illustrated in FIG. 11.

SEVENTH EMBODIMENT

Figure 14:
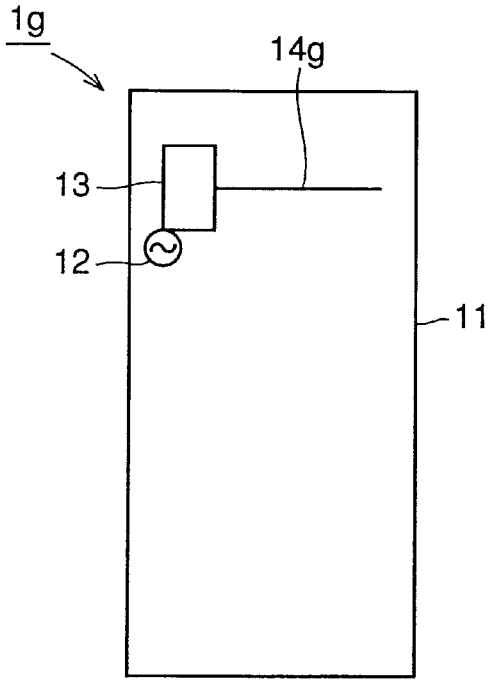
FIG. 14 is a plan view of an antenna element according to a seventh embodiment of the present invention.

FIG. 14 is a plan view of an antenna element according to the seventh embodiment of the present invention. Referring to FIG. 14, an antenna element 1*g* according to the seventh embodiment is different from antenna element 1*d* illustrated in FIG. 11, which has meander line antenna 14*d* as the second antenna, in that antenna element 1*g* has a monopole antenna 14*g* as the second antenna.

Antenna element 1*g* having the above-mentioned structure also has the same advantages as antenna element id illustrated in FIG. 11.

EIGHTH EMBODIMENT

Figure 15:
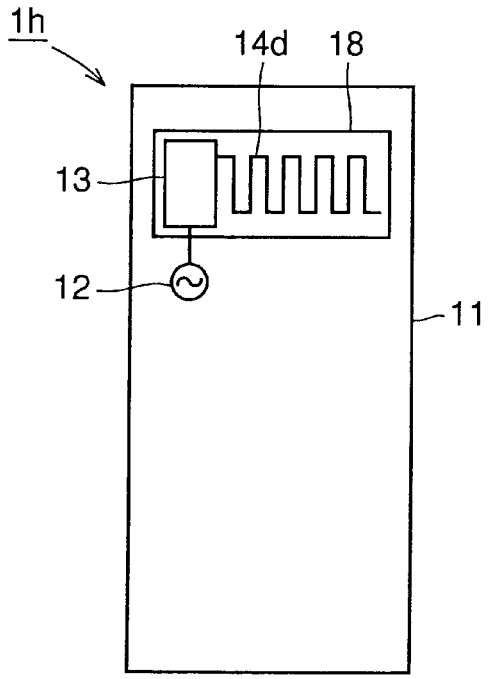
FIG. 15 is a plan view of an antenna element according to an eighth embodiment of the present invention.

FIG. 15 is a plan view of an antenna element according to the eighth embodiment of the present invention. Referring to FIG. 15, an antenna element 1*h* according to the eighth embodiment is different from antenna element 1*d* illustrated in FIG. 11, which has no dielectric 18, in that a dielectric 18 is formed on a metal substrate 11 and a plate antenna 13 and a meander line antenna 14*d* are formed on dielectric 18.

Dielectric 18 is made of a material having a small dielectric tangent tan δ and a high relative dielectric constant, for example, a ceramic material(relative dielectric constant ≈7–100), Teflon (relative dielectric constant ≈2.1) or a resin material (relative dielectric constant ≈3.3) such as Vectra.

Antenna element 1*h* having the above-mentioned structure has the same advantages as antenna element id illustrated in FIG. 11. Since plate antenna 13 and meander line antenna 14*d* are put on dielectric 18 having a high relative dielectric constant, the wavelength of a radio wave advancing in plate antenna 13 and meander line antenna 14*d* can be made short. As a result, the size of plate antenna 13 and meander line antenna 14*d* can be made small. The size of metal substrate 11 can also be made small.

NINTH EMBODIMENT

Figure 16:
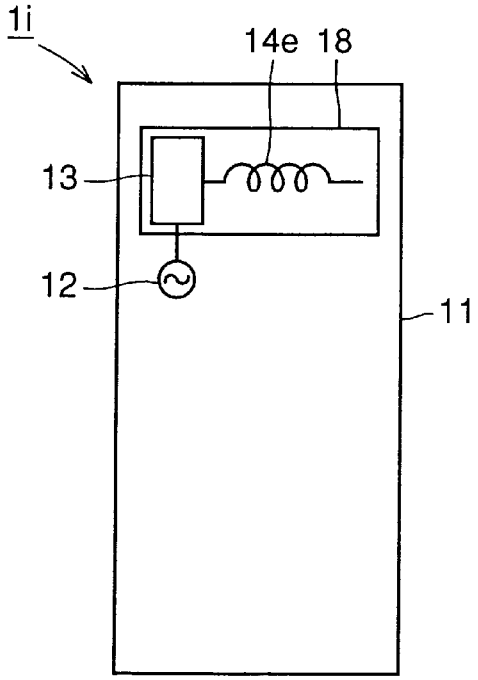
FIG. 16 is a plan view of an antenna element according to a ninth embodiment of the present invention.

FIG. 16 is a plan view of an antenna element according to the ninth embodiment of the present invention. Referring to FIG. 16, an antenna element 1*i* according to the ninth embodiment is different from antenna element 1*h* illustrated in FIG. 15 in that antenna element 1*i* has a helical antenna 14*e* as the second antenna part.

Antenna element 1*i* having the above-mentioned structure has the same advantages as antenna element 1*h* illustrated in FIG. 15.

TENTH EMBODIMENT

Figure 17:
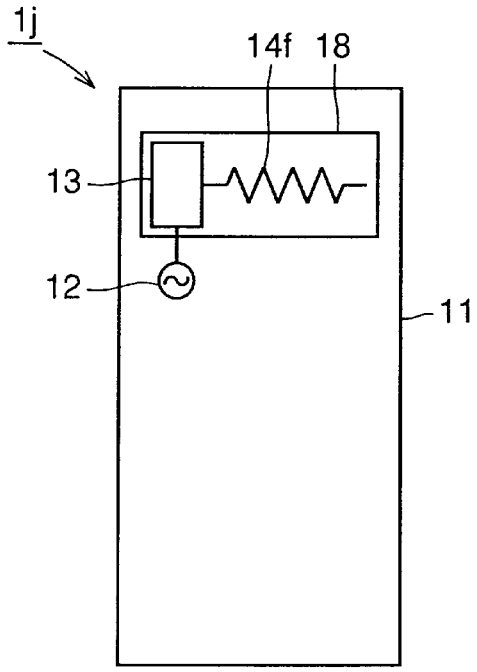
FIG. 17 is a plan view of an antenna element according to a tenth embodiment of the present invention.

FIG. 17 is a plan view of an antenna element according to the tenth embodiment of the present invention. Referring to FIG. 17, an antenna element 1*j* according to the tenth embodiment is different from antenna element 1*h* illustrated in FIG. 15 in that antenna element 1*j* has a zigzag antenna 14*f* as the second antenna part.

Antenna element 1*j* having the above-mentioned structure has the same advantages as antenna element 1*h* illustrated in FIG. 15.

ELEVENTH EMBODIMENT

Figure 18:
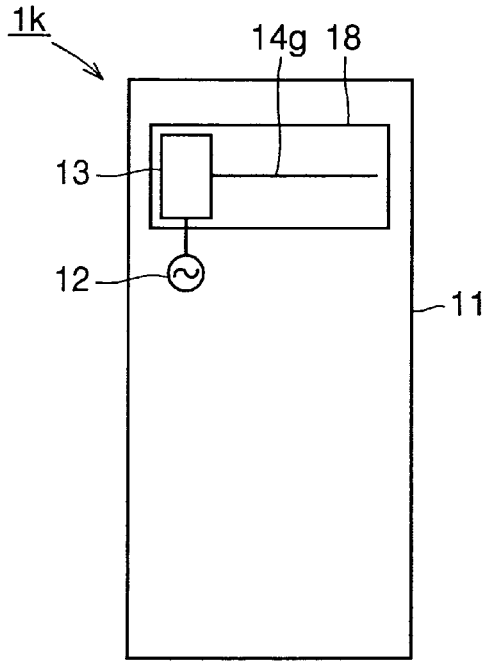
FIG. 18 is a plan view of an antenna element according to an eleventh embodiment of the present invention.

FIG. 18 is a plan view of an antenna element according to the eleventh embodiment of the present invention. Referring to FIG. 18, an antenna element 1*k* according to the eleventh embodiment is different from antenna element 1*h* illustrated in FIG. 15 in that antenna element 1*k* has a monopole antenna 14*g* as the second antenna.

Antenna element 1*k* having the above-mentioned structure also has the same advantages as antenna element 1*h* illustrated in FIG. 15.

TWELFTH EMBODIMENT

Figure 19:
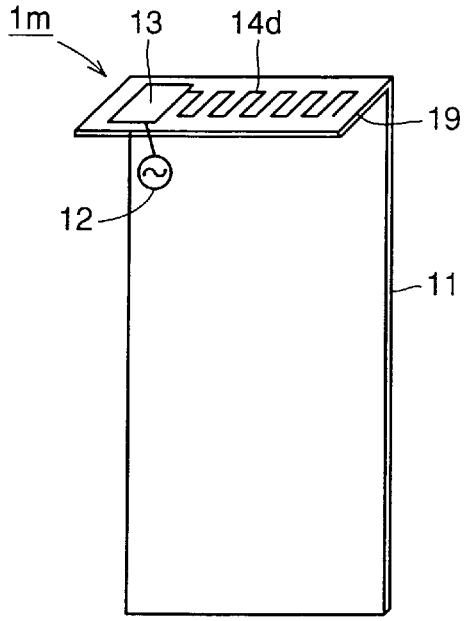
FIG. 19 is a perspective view of an antenna element according to a twelfth embodiment of the present invention.

FIG. 19 is a perspective view of an antenna element according to the twelfth embodiment of the present invention. Referring to FIG. 19, an antenna element 1*m* according to the twelfth embodiment has a metal substrate 11, a plate member 19, a plate antenna 13, and a meander line antenna 14*d*. Plate member 19 is fixed to metal substrate 11. Plate member 19 has a structure wherein a dielectric and a metal plate overlap with each other. Plate member 19 is fitted perpendicularly to metal substrate 11. Therefore, metal substrate 11 and plate member 19 are jointed to each other to form an L-shaped base plate. Plate member 19 is set up on the top face of metal substrate 11.

Plate antenna 13 and meander line antenna 14*d* are made on plate member 19. Plate antenna 13 is connected to a feeding point 12. Plate antenna 13 and meander line antenna 14*d* spread to extend in the direction perpendicular to the main face of metal substrate 11.

Antenna element 1*m* having the above-mentioned structure has the same advantages as antenna element 1*a* illustrated in FIGS. 1 and 2.

Furthermore, the length of the longitudinal direction of metal substrate 11 can be made short since plate antenna 13 and meander line antenna 14*d* are put on plate member 19 set up perpendicularly to metal substrate 11. For this reason, the size of metal substrate 11 can be made small and the area for mounting the antenna element can be made small.

THIRTEENTH EMBODIMENT

Figure 20:
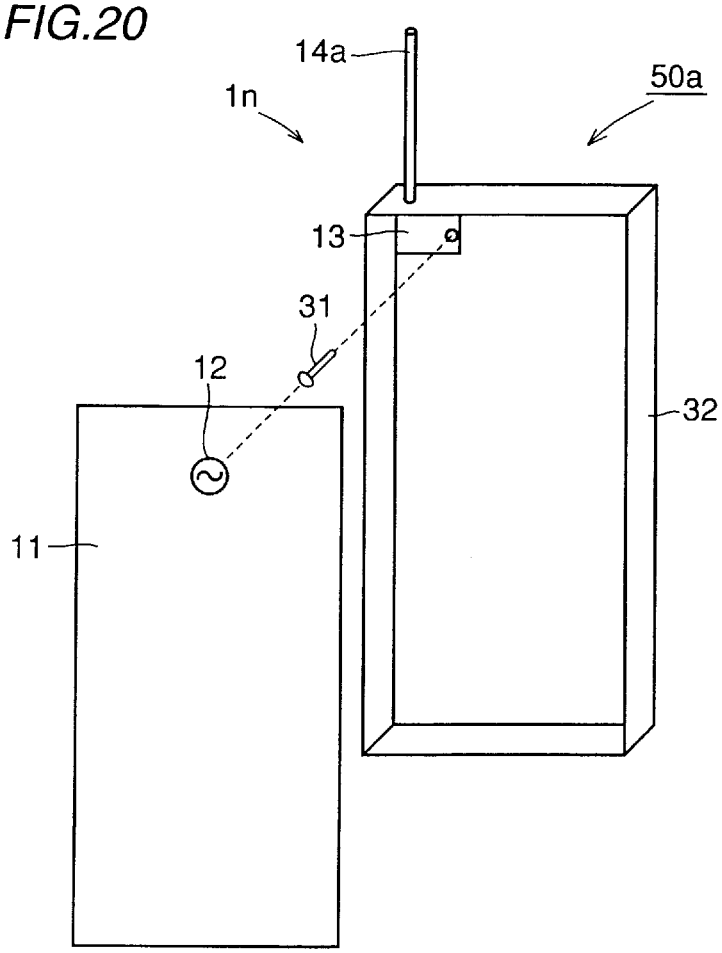
FIG. 20 is a perspective view of an antenna element according to a thirteenth embodiment of the present invention and a portable telephone using this antenna element.

FIG. 20 is a perspective view of an antenna element according to the thirteenth embodiment of the present invention and a portable telephone using this antenna element. Referring to FIG. 20, a portable telephone 50*a* according to the present invention has an antenna element in and a rear case 32 for storing this antenna element.

Antenna element in has a plate antenna 13 as a first antenna part, a monopole antenna 14*a* as a second antenna part, and a metal substrate 11 as a base plate. Plate antenna 13 and monopole antenna 14*a* are fixed to rear case 32. Plate antenna 13 is set in rear case 32, and monopole antenna 14*a* is set to project from rear case 32. Plate antenna 13 and monopole antenna 14*a* are connected to each other. A feeding point 12 is set on metal substrate 11. Feeding point 12 is connected to one end of plate antenna 13 through a metal pin 31. Metal substrate 11 is also stored in rear case 32. A non-illustrated radio section is made on metal substrate 11.

Antenna element in having the above-mentioned structure has the same constitution as antenna element 1*a* illustrated in FIGS. 1 and 2, so as to have the same advantages as antenna element 1*a* illustrated in FIGS. 1 and 2.

Furthermore, portable telephone 50*a* according to the present invention has a broad usable band since it has antenna element 1*h*. Thus, telephone 50*a* makes it possible to transmit and receive radio waves having broad frequencies. As a result, for example, two functions of PHS and a portable telephone can be fulfilled.

Since this antenna element has no matching circuit, loss of electric signals by a matching circuit is not generated.

At the time of production, precision can be made high.

FOURTEENTH EMBODIMENT

Figure 21:
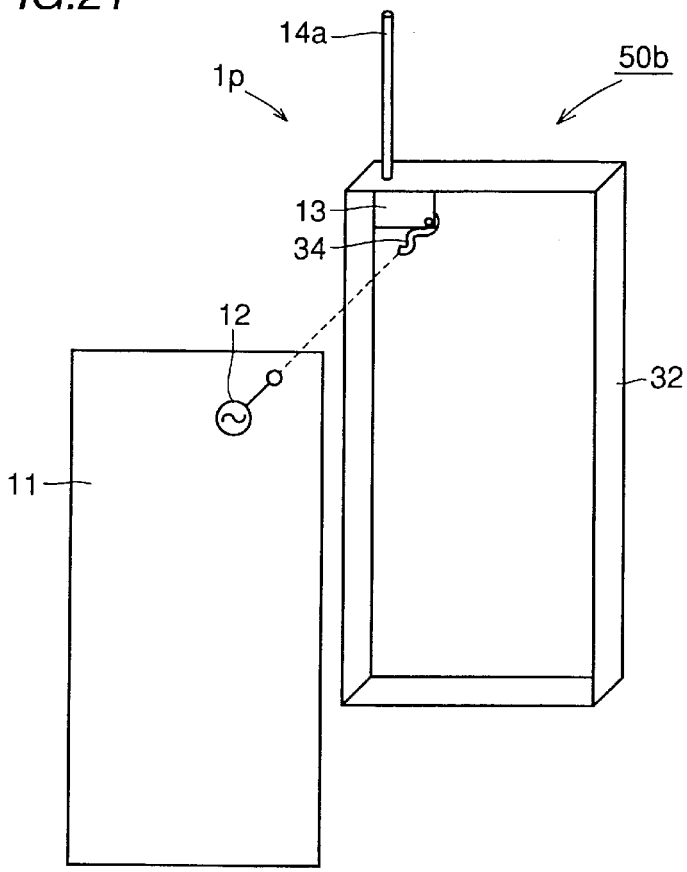
FIG. 21 is a perspective view of an antenna element according to a fourteenth embodiment of the present invention and a portable telephone using this antenna element.

FIG. 21 is a perspective view of an antenna element according to the fourteenth embodiment of the present invention and a portable telephone using this antenna element. Referring to FIG. 21, a portable telephone 50*b* according to the present invention has an antenna element 1*p* and a rear case 32. Antenna element 1*p* is different from antenna element 1*n* illustrated in FIG. 20, which has no contact spring, in that antenna element 1*p* has a contact spring 34 which also functions as an antenna at one end of a plate antenna 13. Contact spring 34 is connected to a feeding point 12.

Antenna element 1*p* having the above-mentioned structure has the same advantages as antenna element in illustrated in FIG. 20.

Furthermore, portable telephone 50*b* using this antenna element 1*p* has a broad usable band and gives a small loss in the same way as portable telephone 50*a* illustrated in FIG. 20.

The number of the parts also becomes small.

FIFTEENTH EMBODIMENT

Figure 22:
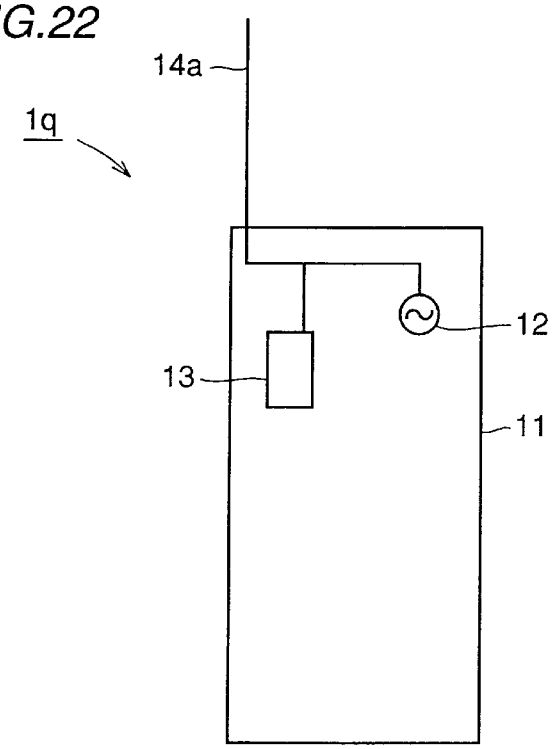
FIG. 22 is a plan view of an antenna element according to a fifteenth embodiment of the present invention.

FIG. 22 is a plan view of an antenna element according to the fifteenth embodiment of the present invention. Referring to FIG. 22, an antenna element 1*q* has a monopole antenna 14*a* as a first antenna part, a plate antenna 13 as a second antenna part, and a metal substrate 11.

Plate antenna 13 is put on metal substrate 11. Monopole antenna 14*a* is set up to extend from metal substrate 11. Monopole antenna 14*a* and plate antenna 13 are connected in parallel to a feeding point 12. As described about the above-mentioned embodiment, monopole antenna 14*a* may be substituted with the above-mentioned helical antenna 14*b* or 14*e*, zigzag antenna 14*f*, meander line antenna 14*d*, monopole antenna 14*g* or the like. Monopole antenna 14*a* may be put on metal substrate 11. A material having a high dielectric constant may be interposed between monopole antenna 14*a*, plate antenna 13 and metal substrate 11.

Figure 23:
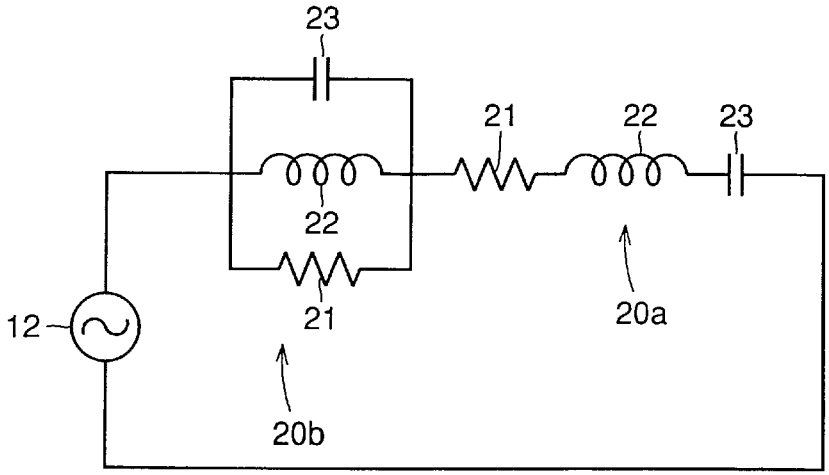
FIG. 23 is an equivalent circuit diagram of the antenna element illustrated in FIG. 22.

FIG. 23 is an equivalent circuit diagram of the antenna element illustrated in FIG. 22. Referring to FIG. 23, plate antenna 13 is substantially equivalent to a series resonant circuit 20*a* wherein a resistance 21, a coil 22 and a condenser 23 are connected in series to each other. Monopole antenna 14*a* is substantially equivalent to a parallel resonant circuit 20*b* wherein a resistance 21, a coil 22 and a condenser 23 are connected in parallel to each other. The two circuits are jointed to each other.

Figure 24:
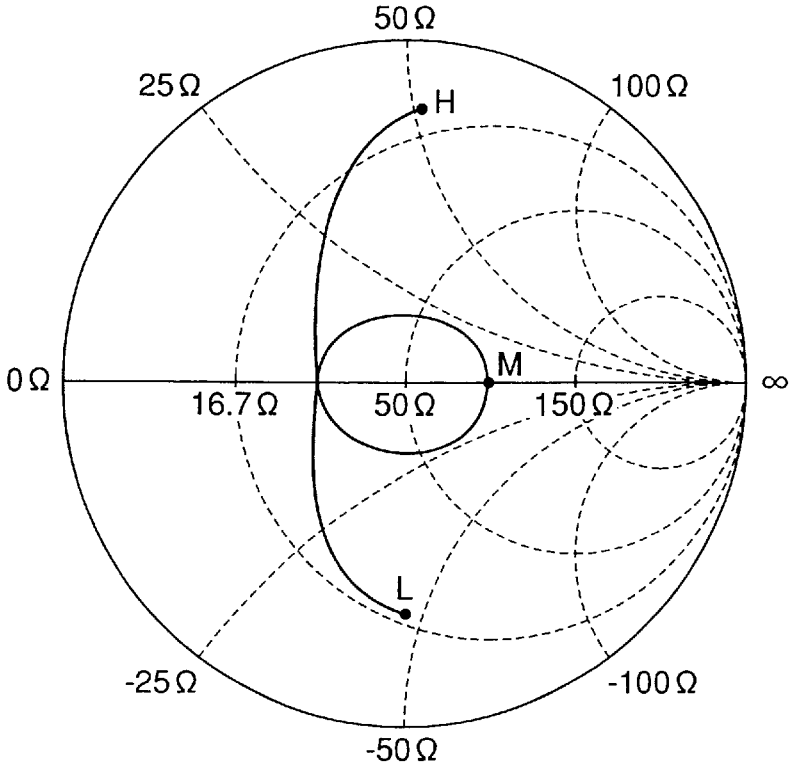
FIG. 24 is a Smith chart for explaining the property of the antenna element illustrated in FIG. 22.

FIG. 24 is a Smith chart for explaining the impedance property of the antenna element illustrated in FIG. 22. Referring to FIG. 24, about radio waves having a high frequency, the imaginary part of the impedance of antenna element 1*q* is positive as shown at a point H. As its frequency becomes lower, the imaginary part of the impedance approaches zero. Furthermore, the track of the impedance moves to surround the central point of the Smith chart. As the frequency is made lower, the imaginary part of the impedance becomes negative. As shown at a point L, when the frequency is smallest, the imaginary part of the impedance is most negative so that the track is apart from the central point of the Smith chart.

The Smith chart shown in FIG. 24 is compared with the Smith charts of the plate antenna and the monopole antenna shown in FIGS. 4 and 6. In the Smith chart shown in FIG. 24, the distance between points H & L and the center of the chart is shorter than the distance between points H & L of in the Smith chart shown in FIGS. 4 and 6 and the center of this chart. This is because series resonant circuit 20*a* and parallel resonant circuit 20*b* have different properties and the circuits are jointed to each other so that their properties are mutually cancelled out. In this manner, impedance-matching is attained.

It can be understood that most of the track of the impedance is present near the center of the Smith chart so that the reflection coefficient of antenna element 1*q* is small. As a result, antenna element 1*q* has a small reflection coefficient over a broad band so that element 1*q* can be used in the broad band.

Impedance-matching can be attained without using any matching circuit. Therefore, loss of electrical signals in a matching circuit, as is conventionally seen, is not generated.

Specific examples of the present invention will be described hereinafter.

Figure 25:
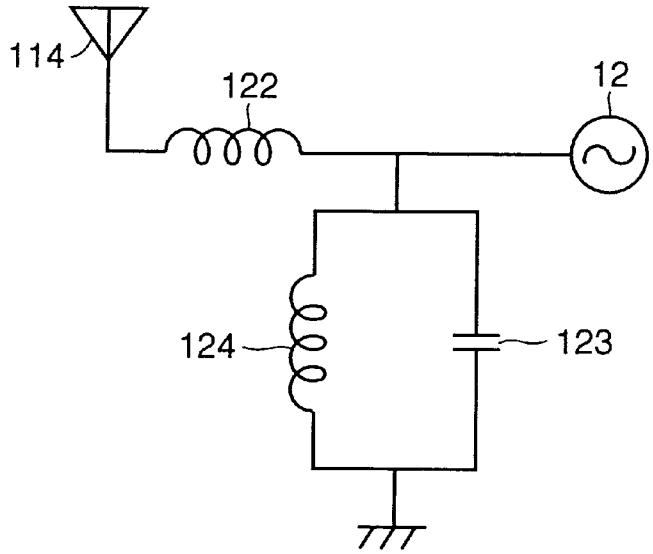
FIG.25 PRIOR ART
FIG. 25 is a circuit diagram of a conventional antenna element.

FIG. 25 is a circuit diagram of a conventional antenna element. Referring to FIG. 25, the antenna element was composed of an antenna 114, a coil 122, a stub 124 and a condenser 123. Coil 122 has an inductance of 6.8 nH. Condenser 123 has a capacity of 4 pF. Antenna 114 is composed of a monopole antenna and has a length of 55 mm (electric length: $3\lambda/8$). A radio wave having frequencies of 1.5 GHz to 2.5 GHz was inputted to the antenna element having the above-mentioned matching circuit, and then the impedance, the Smith chart and the VSWR of the antenna element were examined. About specified points, the impedance and the VSWR thereof are shown in Table 1.

TABLE 1

| Point | Frequency (GHz) | Impedance of the antenna element having the matching circuit(Ω) Real part(Ω) | Imaginary part(Ω) | VSWR |
|---|---|---|---|---|
| 201 | 1.92 | 58 | 0 | 1.2 |
| 202 | 1.98 | 44 | 3 | 1.3 |
| 203 | 2.11 | 48 | 14 | 1.4 |
| 204 | 2.17 | 48 | −10 | 1.4 |

Figure 26:
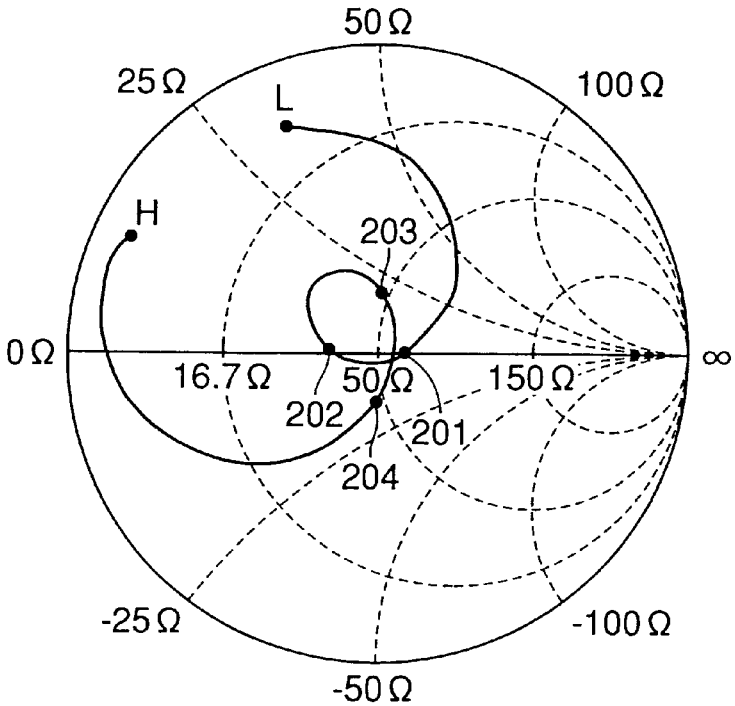
FIG.26 PRIOR ART
FIG. 26 is a Smith chart for explaining the property of the conventional antenna element.

The smith chart is shown in FIG. 26. A relationship between the frequency and the VSWR is shown in FIG. 27.

The Smith chart shown in FIG. 26 demonstrates that the reflection coefficient of the conventional antenna element was large in a band having high frequencies and a band having low frequencies. On the other hand, as shown at points 201–204, the reflection coefficient was small in the frequency range of 1.9 GHz to 2.2 GHz.

Figure 27:
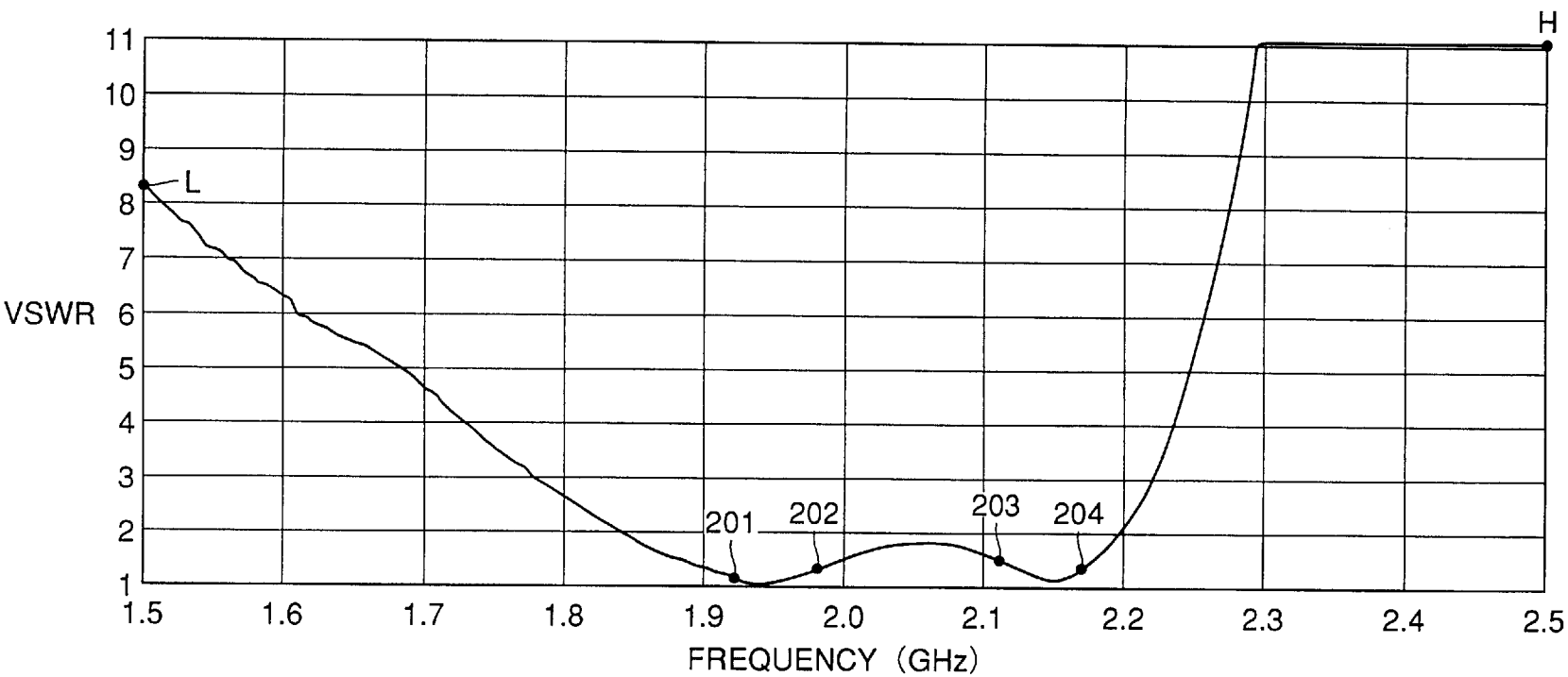
FIG.27 PRIOR ART
FIG. 27 is a graph showing a relationship between frequency and VSWR in the conventional antenna element.

FIG. 27 demonstrates that the band in which a VSWR of 2 or less was given was a band having a frequency of 1.84 GHz to 2.20 GHz. The relative band width was 18%. In the specification, the "relative band width" means a relative band width about the band in which a VSWR of 2 or less is given. The relative band width can be obtained by the following equation:

Relative band width=(the maximum value of the frequency giving a VSWR of 2−the minimum value of the frequency giving a VSWR of 2)/2.0 GHz From the above, it can be understood that the conventional antenna element was an antenna element having a narrow relative band width even if the antenna element had the matching circuit.

As a product of the present invention, the antenna element 1*a* illustrated in FIGS. 1 and 2 was prepared. In this antenna element 1*a*, lengths $W_1$ and $W_2$ of sides of plate antenna 13 were set to 0.03λ and 0.04λ. Thickness (electric length) H of dielectric 15 made of Teflon (relative dielectric constant: 2.1) was set to 0.015λ. The length of monopole antenna 14*a* was set to 50 mm (electric length: 3λ/8).

A radio wave having frequencies of 1.5 GHZ to 2.5 GHz was introduced from feeding point 12 to antenna element 1*a*, and then the impedance, the Smith chart and the VSWR of the antenna element 1*a* were obtained. About specified points, the impedance and the VSWR thereof are shown in Table 2.

TABLE 2

| Point | Frequency (GHz) | Impedance of the antenna element(Ω) Real part(Ω) | Imaginary part(Ω) | VSWR |
|---|---|---|---|---|
| 211 | 1.92 | 38.881 | −7.9688 | 1.3617 |
| 212 | 1.98 | 43.418 | 0.7422 | 1.1525 |
| 213 | 2.11 | 49.703 | −12.436 | 1.282 |
| 214 | 2.17 | 43.465 | −16.473 | 1.4583 |

Figure 28:
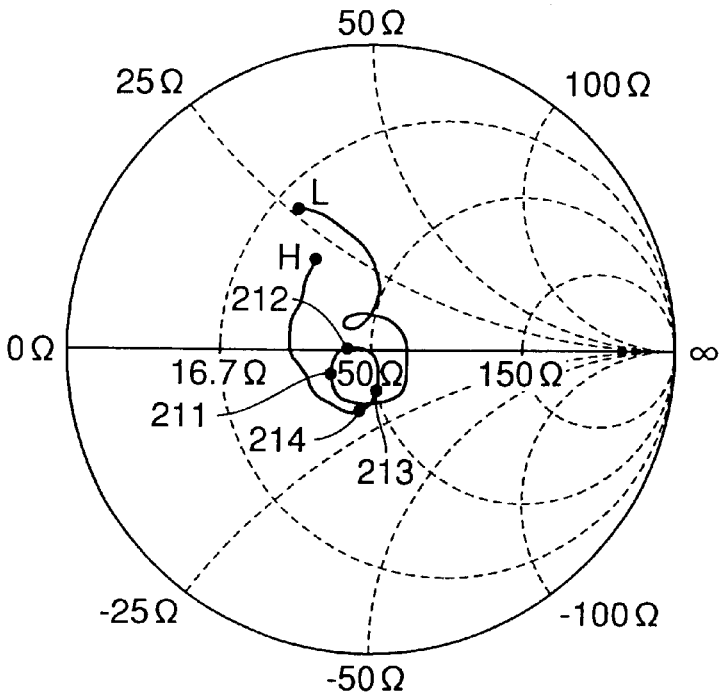
FIG. 28 is a Smith chart for explaining the property of an antenna element of the present invention.
Figure 29:
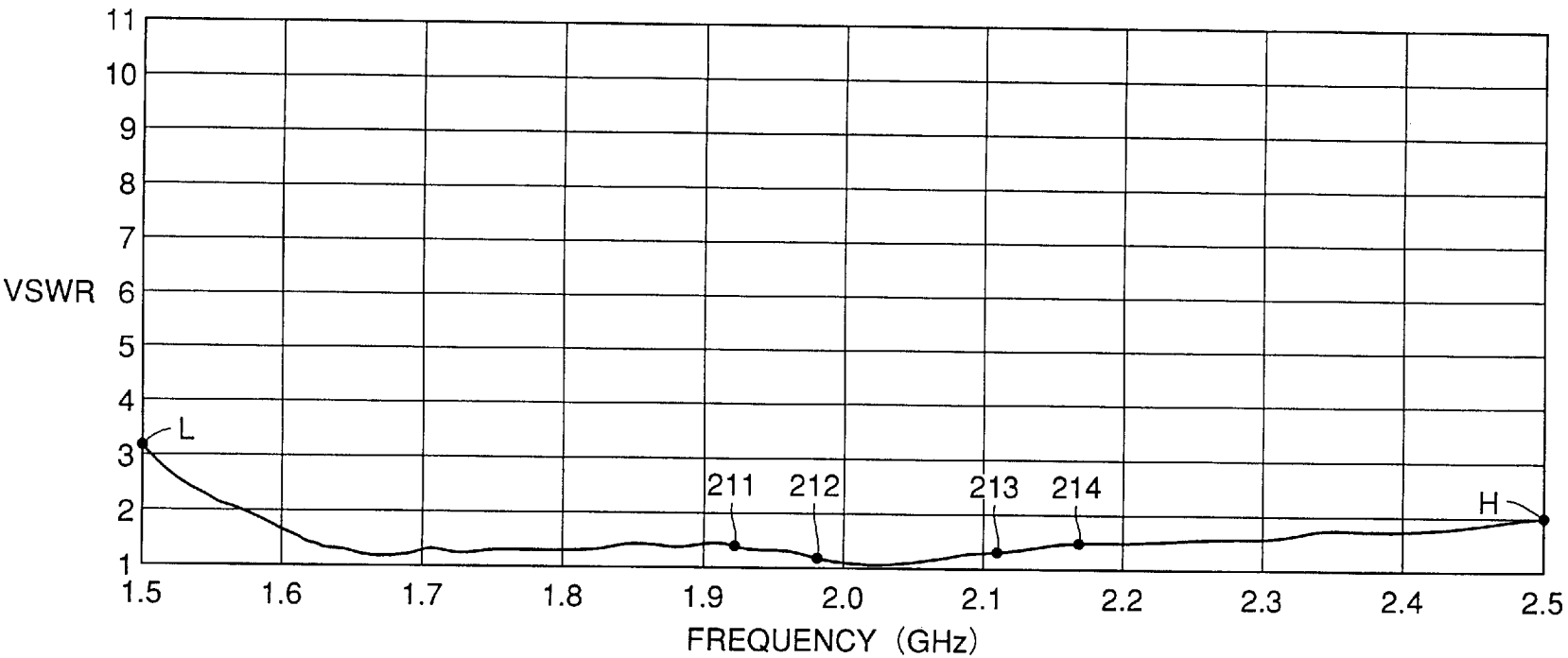
FIG. 29 is a graph showing a relationship between frequency and VSWR in the antenna element of the present invention.

The smith chart is shown in FIG. 28. A relationship between the frequency and the VSWR is shown in FIG. 29.

FIG. 28 demonstrates that the track of the impedance of the antenna element according to the present invention concentrates near the central point of the Smith chart. Thus, the reflection coefficient of the antenna element is small. Since points 211–214 are positioned near the central point of the Smith chart, the reflection coefficient is particularly small in this band.

It can be understood from the above-mentioned results that antenna element 1*a* according to the present invention has a small reflection coefficient over a broad band. As shown in FIG. 29, in a broad band having frequencies of 1.57 GHz to 2.50 GHz a VSWR of 2 or less is given. When the relative band width was obtained from FIG. 29, it was 46.5%.

From the above, it can be understood that the antenna element according to the present invention had a VSWR of 2 or less in a broader band, as compared with the conventional antenna element. Therefore, the antenna element according to the present invention can be used in a broad band.

Next, a sample according to the present invention was prepared, in which a length of monopole antenna 14*a* was set to 115 mm (electric length: 7/8λ) and the other structures had the same as the antenna element about which the data shown in FIGS. 28 and 29 were collected. A radio wave having frequencies of 1.5 GHZ to 2.5 GHz was also introduced from feeding point 12 to this sample, and then the impedance, the Smith chart and the VSWR of the antenna element were obtained.

About specified points, the impedance and the VSWR thereof are shown in Table 3.

TABLE 3

| Point | Frequency (GHz) | Impedance of the antenna element(Ω) Real part(Ω) | Imaginary part(Ω) | VSWR |
|---|---|---|---|---|
| 221 | 1.92 | 39.492 | 1.6641 | 1.2695 |
| 222 | 1.98 | 35.598 | 4.9961 | 1.4321 |
| 223 | 2.11 | 36.408 | −3.5723 | 1.3871 |
| 224 | 2.17 | 28.409 | −1.3828 | 1.7606 |

Figure 30:
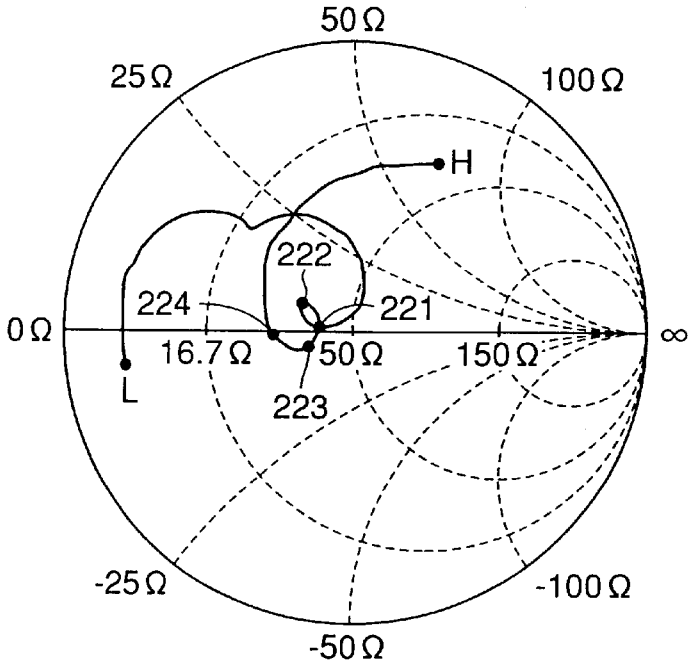
FIG. 30 is a Smith chart for explaining the property of an antenna element of the present invention.

The smith chart is shown in FIG. 30. A relationship between the frequency and the VSWR is shown in FIG. 31.

FIG. 30 demonstrates that the track of the impedance of the product according to the present invention concentrates near the central point of the Smith chart. Since points 221–224 are positioned near the central point of the Smith chart, the reflection coefficient is particularly small in this band.

Figure 31:
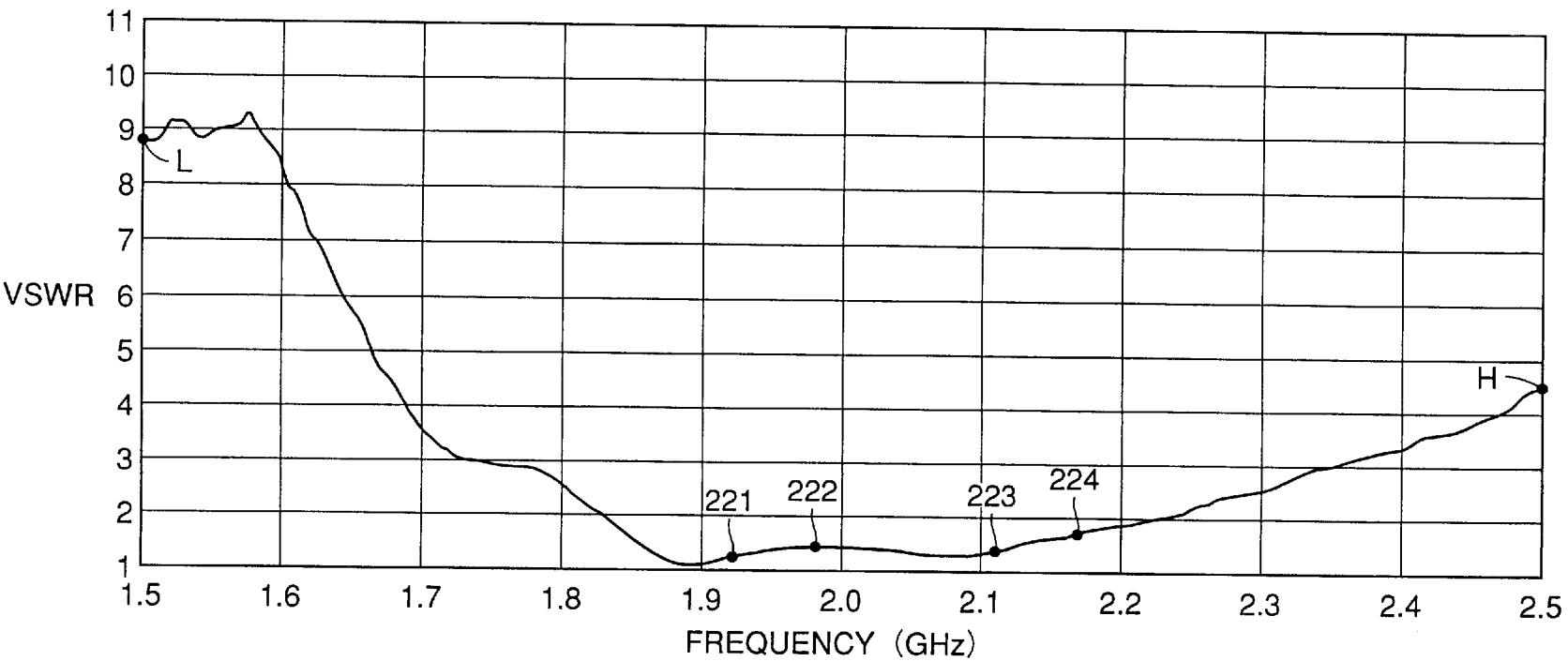
FIG. 31 is a graph showing a relationship between frequency and VSWR in the antenna element of the present invention.

Referring to FIG. 31, in a band having small frequencies the VSWR of the present invention product rose. However, the present invention product has a VSWR of 2 or less in a broader band, as compared with the conventional product. As shown in FIG. 31, in a band having frequencies of 1.83 GHz to 2.22 GHz a VSWR of 2 or less is given. When the relative band width was obtained from FIG. 31, it was 20%. It can be understood from the above that even if the length of monopole antenna 14*a* is changed, the present invention product has a broad usable band than the conventional product.

The following will describe an example in which a helical antenna is used. First, a sample wherein antenna 114 illustrated in FIG. 25 was composed of a helical antenna was prepared as a conventional product. The pitch of the helical antenna was set to 3 mm. The electric length of the helical antenna was set to 3λ/8. Other circuit structures were made to the same as illustrated in FIG. 25.

A radio wave having frequencies of 1.5 GHZ to 2.5 GHz was also introduced to this sample, and then the impedance, the Smith chart and the VSWR of the antenna element were obtained. About specified points, the impedance and the VSWR thereof are shown in Table 4.

TABLE 4

| Point | Frequency (GHz) | Impedance of the antenna element having the matching circuit(Ω) Real part(Ω) | Imaginary part(Ω) | VSWR |
|---|---|---|---|---|
| 231 | 1.92 | 58 | −30 | 1.8 |
| 232 | 1.98 | 24 | −3 | 2.1 |
| 233 | 2.11 | 60 | 30 | 2.1 |
| 234 | 2.17 | 48 | −28 | 2.0 |

Figure 32:
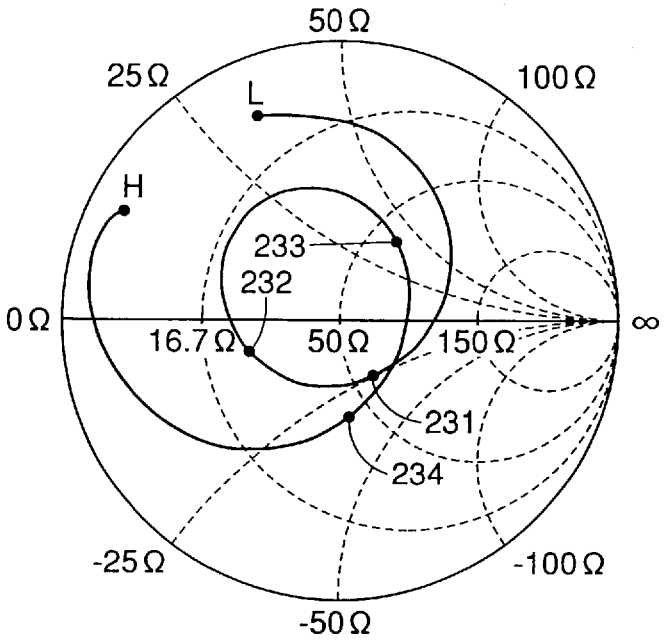
FIG.32 PRIOR ART
FIG. 32 is a Smith chart for explaining the property of a conventional antenna element.

The smith chart is shown in FIG. 32. A relationship between the frequency and the VSWR is shown in FIG. 33.

FIG. 32 demonstrates that about the conventional product using the helical antenna, the track of the impedance thereof is largely out of the central point of the Smith chart even if the product has the matching circuit. About points 231–234 of middle frequencies as well as a point L of the smallest frequency and a point H of the largest frequency, the reflection coefficients thereof are large.

Figure 33:
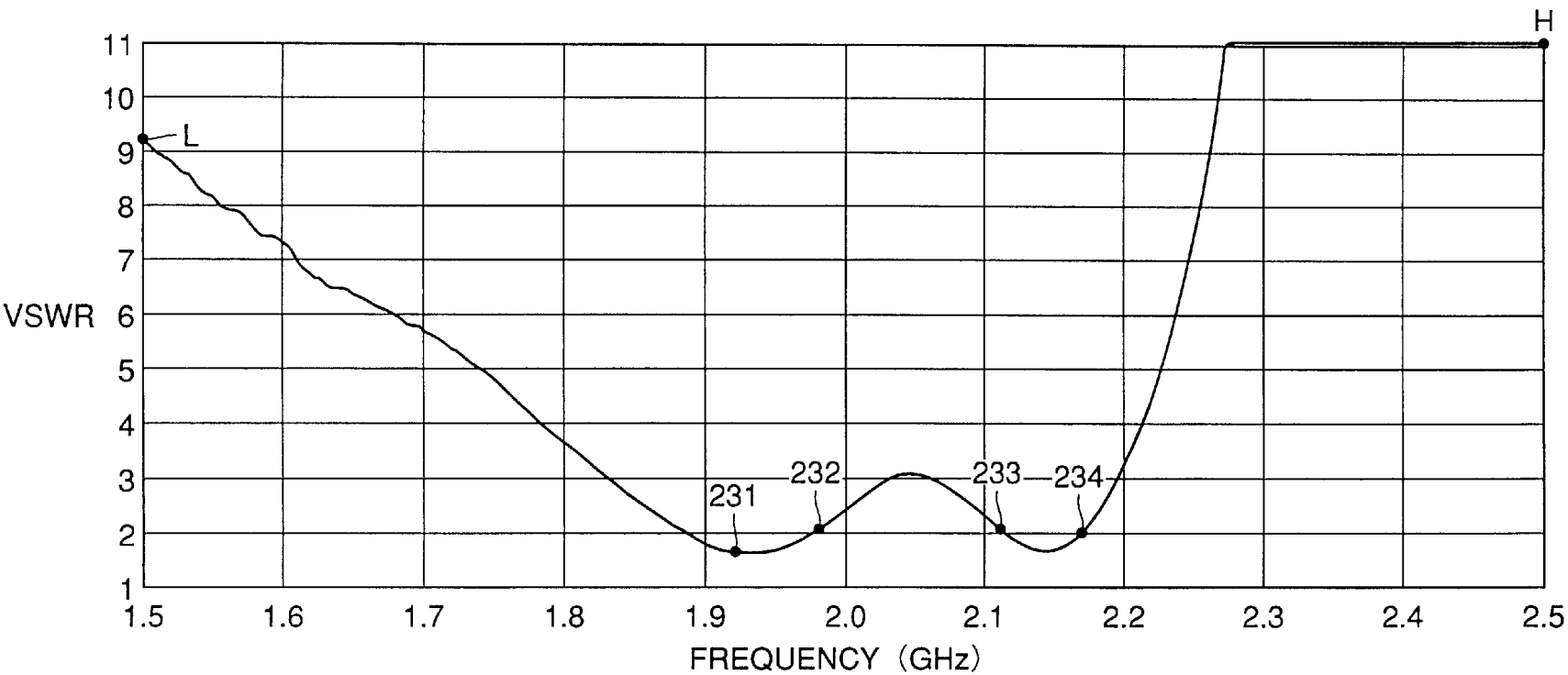
FIG.33 PRIOR ART
FIG. 33 is a graph showing a relationship between frequency and VSWR in the conventional antenna element.

Referring to FIG. 33, a VSWR of 2 or less is given in the frequency range of 1.89 GHz to 1.97 GHz and in the frequency range of 2.12 GHz to 2.17 GHz. It can be understood that the band in which a VSWR of 2 or less is given is narrow. When the relative band width was obtained from FIG. 33, it was 6.5%.

As described above, the conventional product in which the helical antenna is used has a narrow usable band. Thus, it can be understood that the conventional product is an antenna element which could be used as a high-efficiency antenna only in a small band.

Next, a product of the present invention having helical antenna 14*b* illustrated in FIG. 9 was prepared. The size of plate antenna 13 was made to the same size as the sample about which the data shown in FIGS. 28 and 29 were collected. Furthermore, helical antenna 14*b* was made to the same as in the sample about which the data shown in FIGS. 32 and 33 were collected.

A radio wave having frequencies of 1.5 GHZ to 2.5 GHz was also introduced to this sample, and then the impedance, the Smith chart and the VSWR were obtained. About specified points, the impedance and the VSWR thereof are shown in Table 5.

TABLE 5

| Point | Frequency (GHz) | Impedance of the antenna element(Ω) Real part(Ω) | Imaginary part(Ω) | VSWR |
|---|---|---|---|---|
| 241 | 1.92 | 33.908 | −3.2734 | 1.4857 |
| 242 | 1.98 | 32.09 | 4.4355 | 1.5784 |
| 243 | 2.11 | 32.586 | 12.148 | 1.6805 |
| 244 | 2.17 | 33.92 | 17.066 | 1.7524 |

Figure 34:
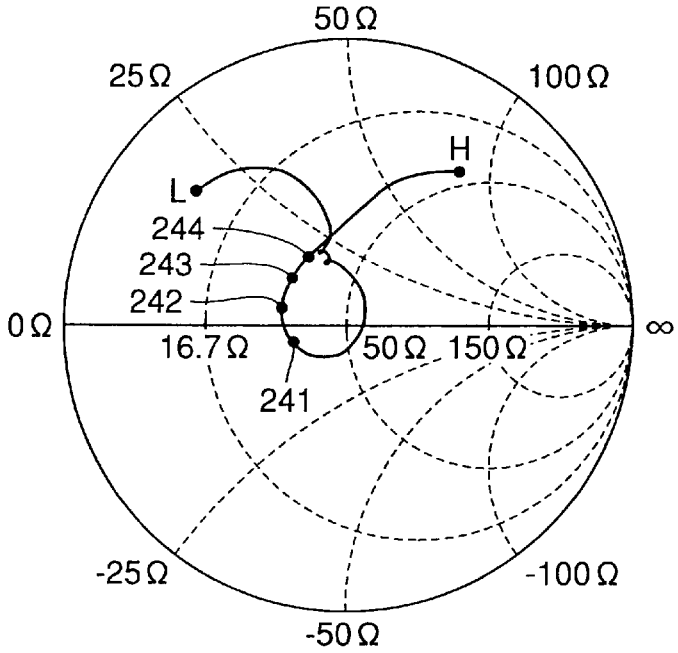
FIG. 34 is a Smith chart for explaining the property of an antenna element of the present invention.

The smith chart is shown in FIG. 34. A relationship between the frequency and the VSWR is shown in FIG. 35.

FIG. 34 demonstrates that the present invention product has large reflection coefficients at a point H of a high frequency and at a point L of a low frequency, as compared with the conventional product. However, points 241–244 of middle frequencies are near the central point of the Smith chart and thus the reflection coefficients are low.

Figure 35:
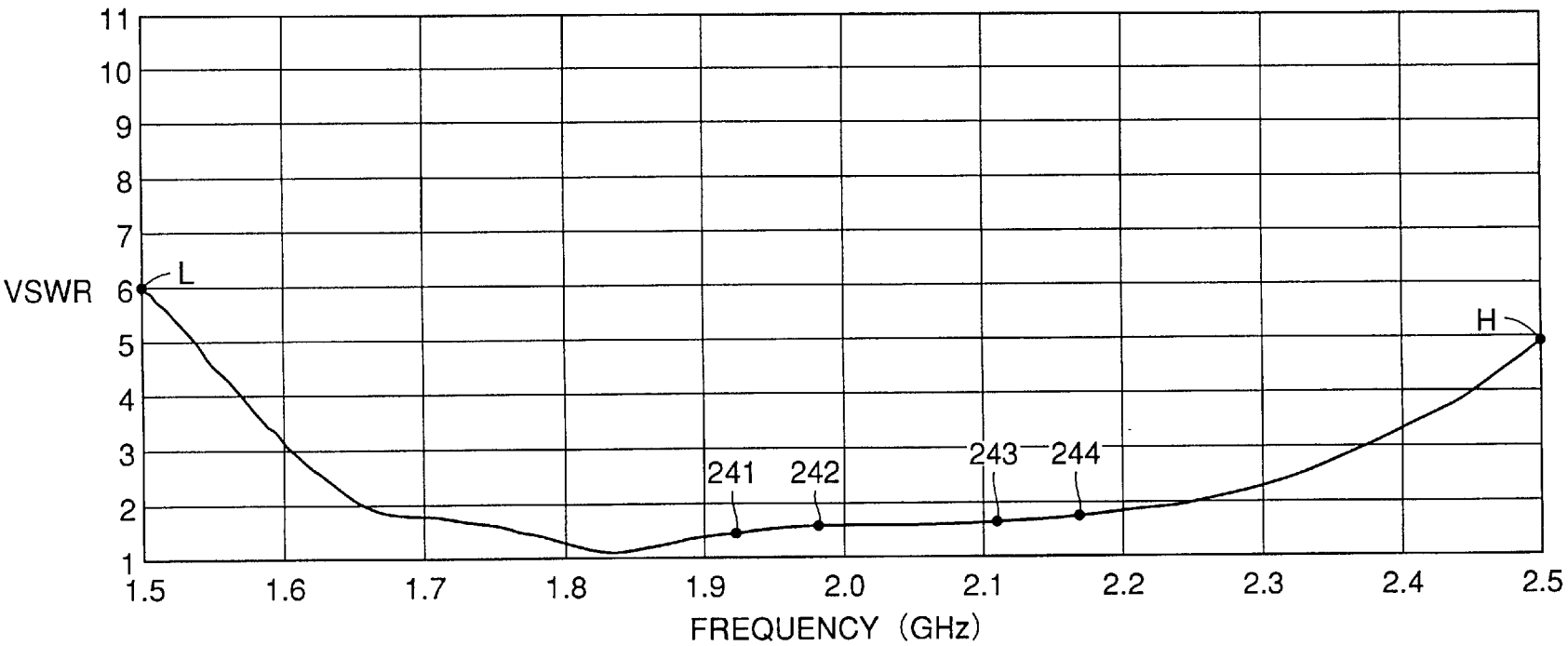
FIG. 35 is a graph showing a relationship between frequency and VSWR in the antenna element of the present invention.

Referring to FIG. 35, in the present invention product a VSWR of 2 or less is given in a broader band, as compared with the conventional product. Specifically, it can be understood that a VSWR of 2 or less is given in the frequency range of 1.66 GHz to 2.25 GHz. When the relative band width was obtained from FIG. 35, it was 31%.

As described above, according to the present invention, it is possible to obtain an antenna element and a portable information terminal having a broad usable band and giving a small loss.

Industrial Applicability

The antenna element according to the present invention can be used in the fields of, for example, a portable information terminal such as a portable telephone, an ordinary radio, a special radio, and a primary radiator of an aperture antenna such as a parabolic antenna.

What is claimed is:

1. An antenna element, comprising:

a first antenna part which is substantially equivalent to a series resonant circuit, and a second antenna part which is brought in contact with and connected to said first antenna part and is substantially equivalent to a parallel resonant circuit, said first and second antenna parts having reverse impedance characteristics connected so that reactances of said first and second antenna parts are substantially mutually canceled out in a predetermined frequency range.

2. The antenna element according to claim 1, wherein said first antenna part and said second antenna part are fitted in series to a feeding point.

3. The antenna element according to claim 1, wherein said first antenna part and said second antenna part are fitted in parallel to a feeding point.

4. The antenna element according to claim 1, wherein the first antenna part comprises a plate antenna, and said second antenna part comprises a linear antenna.

5. The antenna element according to claim 4, wherein said linear antenna comprises at least one selected from the group consisting of a monopole antenna and a helical antenna.

6. The antenna element according to claim 1, which further comprises a substrate whose surface has an electrical conductivity, said first antenna part being set up, through a dielectric, over the surface of said substrate, and said second antenna part being set up to extend from said substrate.

7. The antenna element according to claim 1, which further comprises a substrate whose surface has an electrical conductivity, said first antenna part and second antenna part being set up, through a dielectric, over the surface of said substrate.

8. The antenna element according to claim 7, wherein said second antenna part comprises at least one selected from the group consisting of a monopole antenna, a helical antenna, a meander line antenna, and a zigzag antenna.

9. A portable information terminal, comprising an antenna element comprising a first antenna part which is substantially equivalent to a series resonant circuit, and a second antenna part which is connected to said first antenna part and is substantially equivalent to a parallel resonant circuit, said first and second antenna parts having reverse impedance characteristics connected so that reactances of said first and second antenna parts are substantially mutually canceled out in a predetermined frequency range.

* * * * *